US006292653B1

(12) United States Patent
Volz

(10) Patent No.: US 6,292,653 B1
(45) **Date of Patent: *Sep. 18, 2001**

(54) SERVO CASE

(76) Inventor: Michael Volz, Altkönigstr. 9, 60323 Frankfurt (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/241,449

(22) Filed: Feb. 2, 1999

(30) Foreign Application Priority Data

Feb. 4, 1998 (DE) ..... 298 01 836 U

(51) Int. Cl.[7] ..... H04B 1/38
(52) U.S. Cl. ..... 455/90; 455/88
(58) Field of Search ..... 455/90, 88, 347, 455/351; 49/17, 15; 248/27.1; 318/16, 17, 581

(56) References Cited

U.S. PATENT DOCUMENTS

| | | | | |
|---|---|---|---|---|
| 3,784,174 | * | 1/1974 | Tarnofsky | 261/65 |
| 4,480,401 | * | 11/1984 | Matsushiro | 446/456 |
| 4,616,164 | * | 10/1986 | Kenny et al. | 318/666 |
| 4,879,437 | * | 11/1989 | Dard et al. | 200/1 R |
| 4,914,368 | * | 4/1990 | Orton | 318/663 |
| 5,214,364 | * | 5/1993 | Perdue et al. | 318/600 |
| 5,522,575 | * | 6/1996 | Volz | 248/27.1 |
| 5,638,053 | * | 6/1997 | Schuman | 340/825.03 |

* cited by examiner

*Primary Examiner*—William Trost
*Assistant Examiner*—Congvan Tran
(74) *Attorney, Agent, or Firm*—Collard & Roe, PC.

(57) ABSTRACT

A servo case for holding electrical, electronic and mechanical servo components for connection to the receiver of a radio controlled model. The case has a plurality of recesses that allow for the servo components to extend into the recesses to be flush with the outer contour of the case. This feature allows for the cases to be made extremely thin and compact while allowing for the use of larger servo components, thus improving the operation of the servo.

2 Claims, 1 Drawing Sheet

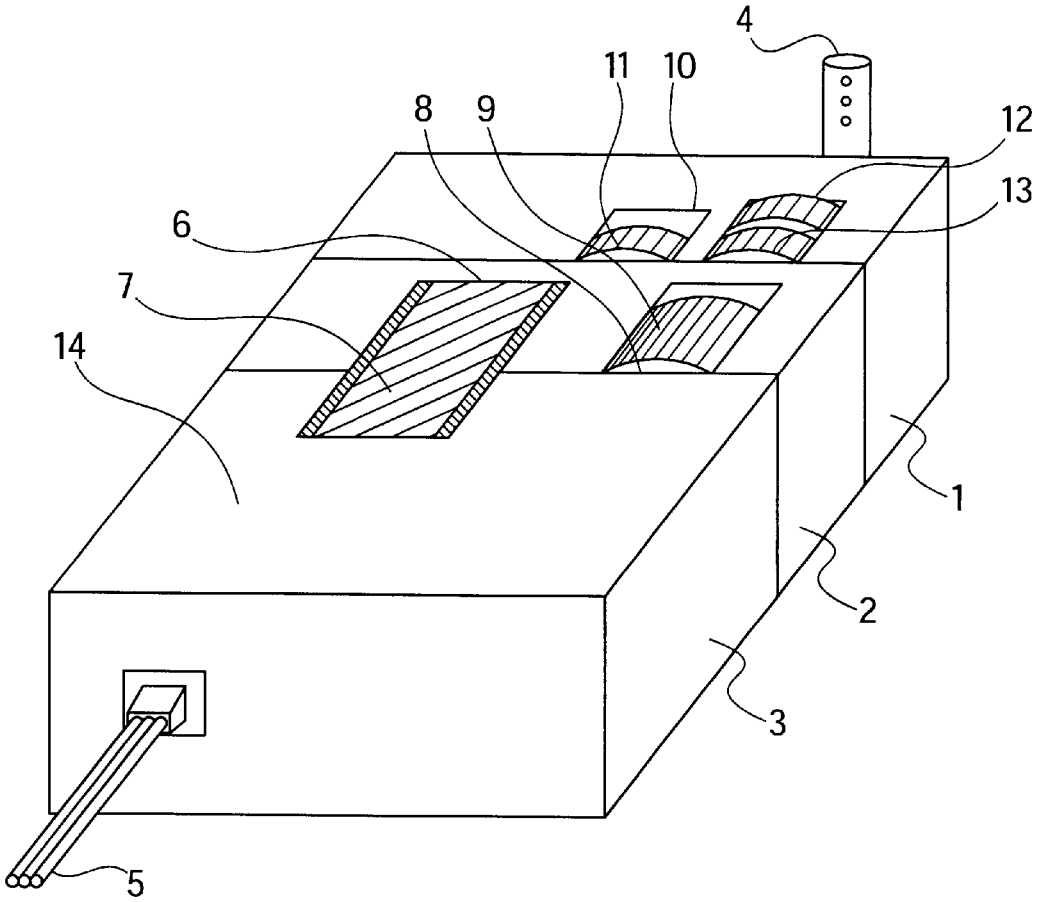
4
11
10
8
9
12
13
6
7
14
1
2
3
5

SERVO CASE

BACKGROUND OF THE INVENTION

1. Field of the Invention

The present invention relates to a servo case used for radio-controlled models such as model airplanes.

2. The Prior Art

There is a general tendency these days towards the use of smaller models and/or for models that use thinner airfoil sections. Accordingly, there is a need for smaller, thinner and lighter components such as the receiver, receiver battery and servos. A servo normally consists of an electric motor, a reduction gear set that is adapted to a potentiometer, an amplifier, metal shafts and an injection molded housing with case screws.

In a servo having a weight of 10 grams, 40% of its weight comes from the case and the case screws, because the average thickness of the injection molded case normally ranges between 1.0 and 1.5 mm. Reducing the thickness of the case greatly increases the costs of manufacture, due to the increased cost of the injection mold. The thickness of the material not only affects the total weight of the case, but also affects the minimum thickness of the servo case itself. In a servo using components of 10 mm thickness, one must add 1.0 mm thickness on both sides of the components to account for the case, thus leading to a minimum case width of 12 mm.

In extreme models having servos, it has become common to eliminate parts or all of the servo case. However, this is very difficult and dangerous, as the open construction does not allow for a proper fixation of the gear shafts and may cause problems if dirt goes between the gears and blocks them from operating. In addition, wires may become dislodged from the motor, amplifier or potentiometer. These disadvantages make it clear that a servo case is necessary for the safe and efficient operation of the servo.

SUMMARY OF THE INVENTION

It is therefore an object of the invention to provide a servo case that is as flat and compact as possible so that it can be used in even the thinnest airfoil sections.

It is another object of the invention to provide a servo case that is very light yet has sufficient stiffness.

It is a further object of the invention to provide a servo case that is inexpensive to manufacture.

It is yet a further object of the invention to provide a servo case that allows the use of the largest possible components, since the size of the components directly affects technical performance. Traditionally, smaller and flatter cases require the use of smaller components. However, a smaller motor provides an inferior performance, and a smaller potentiometer has limited reliability. In addition, reduced diameter of gears gives a reduced gear ratio, which directly limits the torque of a servo.

These and other objects of the invention are accomplished by a servo case having recesses like small windows that accommodate the largest components of the servo, yet allow for a smaller flatter case to be used. This way, the largest components of the servo, i.e., the motor, potentiometer and gears, can extend to the same level as the outer perimeter of the housing. This way, components can be used that have the same measurement as the total case width. Accordingly, components that were traditionally used in a 13 mm servo can now be accommodated in a 10 mm servo. This means that a servo built according to the invention can be built extremely flat and thin, yet very powerful.

BRIEF DESCRIPTION OF THE DRAWING

Other objects and features of the present invention will become apparent from the following detailed description considered in connection with the accompanying drawing. It is to be understood, however, that the drawing is designed as an illustration only and not as a definition of the limits of the invention.

In the drawing,

FIG. 1 shows a perspective view of a servo having the servo case according to the invention.

DETAILED DESCRIPTION OF THE PREFERRED EMBODIMENT

Referring now in detail to the drawing, FIG. 1 shows a perspective view the servo case according to the invention. The servo case consists of a top 1, a middle part 2 and a bottom part 3. There is a moving servo arm 4 and a lead 5, which connects the servo with the receiver of radio control equipment (not shown). There are a plurality of recesses 6, 8, 10 and 12 in the servo case. Recess 6 allows motor 7 to extend up from the inside of the case and to the limits of the outer surface 14 of the case. Recess 8 allows potentiometer 9 to extend to the outer surface 14 of the case also. Recesses 10 and 12 allow gears 11 and 13, respectively, to extend to the outer surface 14 of the case as well. This way, the servo components can be built as large as the outer surface 14 of the case, while still having a case that is as compact as possible.

Accordingly, while only a single embodiment of the present invention have been shown and described, it is obvious that many changes and modifications may be made thereunto without departing from the spirit and scope of the invention.

What is claimed is:

1. A servo case for coupling to a receiver of a radio controlled model, comprising:

a housing for holding servo components comprising a motor, a potentiometer and gears, said housing having a top, a bottom, at least one side wall and an outer contour; and a plurality of window-like recesses in the housing for allowing surfaces of the motor, potentiometer and gears to extend into the housing to the outer contour of the housing and leaving sufficient room for electrical, electronic and mechanical function of the components.

2. A servo for connection to a receiver of a radio-controlled model, comprising:

a housing having a top, a bottom, at least one side wall and an outer contour; and a plurality of window-like recesses in the housing; and a plurality of electrical, electronic and mechanical servo components disposed within the housing, said components comprising a motor, a potentiometer and a plurality of gears, wherein said motor, potentiometer and gears extend into a respective recess to be flush with the outer contour of the housing, wherein said each recess conforms in shape to one of said motor, potentiometer and gears and wherein there is sufficient room within the housing to allow for the mechanical and electrical function of the components.

* * * * *